US005602961A

United States Patent [19]

Kolesnik et al.

[11] Patent Number: 5,602,961

[45] Date of Patent: Feb. 11, 1997

[54] METHOD AND APPARATUS FOR SPEECH COMPRESSION USING MULTI-MODE CODE EXCITED LINEAR PREDICTIVE CODING

[75] Inventors: Victor D. Kolesnik; Andrey N. Trofimov; Irina E. Bocharova; Victor Y. Krachkovsky; Boris D. Kudryashov; Eugeny P. Ovsjannikov; Boris K. Trojanovsky; Sergei I. Kovalov, all of St. Petersburg, Russian Federation

[73] Assignees: Alaris, Inc., Fremont; GT Technology, Saratoga, both of Calif.; a part interest

[21] Appl. No.: 251,471

[22] Filed: May 31, 1994

[51] Int. Cl.[6] ..... G10L 3/02

[52] U.S. Cl. ..... 395/2.32; 395/2.3; 395/2.38; 395/2.39; 395/2.73; 395/2.34; 395/2.28; 395/2.71; 381/38; 381/36

[58] Field of Search ..... 381/29, 30, 36–38, 381/51; 395/2.28–2.39, 2.67, 2.71–2.74

[56] References Cited

U.S. PATENT DOCUMENTS

| | | | |
|---|---|---|---|
| 4,472,832 | 9/1984 | Atal et al. | 381/40 |
| 4,736,428 | 4/1988 | Deprettere et al. | 381/38 |
| 4,790,016 | 12/1988 | Mazor et al. | 381/36 |
| 4,817,157 | 3/1989 | Gerson | 381/40 |
| 4,868,867 | 9/1989 | Davidson et al. | 381/36 |
| 4,912,764 | 3/1990 | Hartwell et al. | 381/38 |
| 4,914,701 | 4/1990 | Zibman | 381/36 |
| 4,924,508 | 5/1990 | Crepy et al. | 381/38 |
| 4,932,061 | 6/1990 | Kroon et al. | 381/30 |
| 4,944,013 | 7/1990 | Gouvianakis et al. | 381/38 |
| 4,969,192 | 11/1990 | Chen et al. | 381/31 |
| 4,980,916 | 12/1990 | Zinser | 381/36 |
| 5,012,518 | 4/1991 | Liu et al. | 381/42 |
| 5,060,269 | 10/1991 | Zinser | 381/38 |
| 5,073,940 | 12/1991 | Zinser et al. | 381/47 |
| 5,177,799 | 1/1993 | Naitoh | 381/34 |
| 5,187,745 | 2/1993 | Yip et al. | 381/36 |
| 5,195,137 | 3/1993 | Swaminathan | 381/29 |
| 5,199,076 | 3/1993 | Taniguchi et al. | 381/36 |
| 5,222,189 | 6/1993 | Fielder | 395/2 |
| 5,233,659 | 8/1993 | Ahlberg | 381/30 |
| 5,235,671 | 8/1993 | Mazor | 395/2 |
| 5,255,339 | 10/1993 | Fette et al. | 395/2 |
| 5,369,724 | 11/1994 | Lim | 395/2.15 |
| 5,388,181 | 2/1995 | Anderson et al. | 395/212 |
| 5,394,508 | 2/1995 | Lim | 395/2.38 |
| 5,414,796 | 5/1995 | Jacobs et al. | 395/2.31 |

OTHER PUBLICATIONS

Richard L. Zinser, Steven R. Koch, Celp Coding at 4.0 KB/SEC and Below: Improvements to FS–1016, IEEE 1992, pp. I–313–I316.

(List continued on next page.)

*Primary Examiner*—Kee M. Tung

*Attorney, Agent, or Firm*—Blakely, Sokoloff, Taylor & Zafman

[57] ABSTRACT

An apparatus and method of coding speech. The apparatus includes a first circuit being coupled to receive a first signal, the first signal corresponds to the speech signal. The first circuit is for generating a first set of parameters corresponding to the first frame. The apparatus includes a second circuit, being coupled to receive a second signal and the first set of parameters, the second signal corresponding to the speech signal, and the second circuit is for generating a third signal. The apparatus further includes a pulse train analyzer, being coupled to the second circuit, for generating a third match value, a third set of parameters, and a third excitation value. The apparatus further including a fourth circuit, being coupled to the second circuit, for generating a fourth match value, a fourth set of parameters, and a fourth excitation value. The apparatus further including a fifth circuit, being coupled to the third circuit and the fourth circuit, for selecting a mode corresponding to a match value. The apparatus further including a sixth circuit, being coupled to the fifth circuit, for selecting a selected set of parameters and a selected excitation corresponding to the mode. The apparatus further including a seventh circuit, being coupled to the first circuit and the sixth circuit, for generating an encoded signal responsive to the selected set of parameters and the mode.

26 Claims, 10 Drawing Sheets

OTHER PUBLICATIONS

Peter Lupini, Neil B. Cox, Vladimir Cuperman, A Multi-Mode Variable Rate Celp Coder Based on Frame Classification, pp. 406–409.

Shihua Wang, Allen Gersho, Improved Phonetically-Segmented Vector Excitation Coding at 3.4KB/S, IEEE 1992, pp. I–349I352.

Zhang Xiongwei, Chen Xianzhi, A New Excitation Model for LPC Vocoder at 2.4 KB/S, pp. I65–I68.

Y. J. Liu, On Reducing The Bit Rate of a Celp-Based Speech Coder, IEEE 1992, pp. I49–I52.

Yunus Hussain, Nariman Farvardin, Finite-State Vector Quantization Over Noisy Channels and its Application to LSP Parameters, IEEE 1992, pp. II–133–II–136.

Jesper Haagen, Henrik Neilsen, Steffen Duus Hansen, Improvements in 2.4 KBPSD High-Quality Speech Coding, IEEE 1992, pp. II145–II–148.

Malone, et al. "Trellis-Searched Adaptive Prediction Coding," IEEE (Dec. 1988), pp. 0566–0570.

Malone, et al. "Enumeration and Trellis Searched Coding Schemes for Speech LSP Parameters," IEEE (Jul. 1993), pp. 304–314.

Campbell, Joseph P. Jr. "The New 4800 bps Voice Coding Standard," Military & Government Speech Tech '89 (Nov. 14, 1989), pp. 1–4.

Atal, Bishnu S. "Predictive Coding of Speech at Low Bit Rates," IEEE Transactions on Communications (Apr. 1982), vol. Com-30, No. 4, pp. 600–614.

Davidson, Grant, "Complexity Reduction Methods for Vector Excitation Coding," IEEE (1986), pp. 3055–3058.

Lynch, Thomas J. "Data Compression Techniques and Applications," Van Nostrand Reinhold (1985), pp. 32–33.

METHOD AND APPARATUS FOR SPEECH COMPRESSION USING MULTI-MODE CODE EXCITED LINEAR PREDICTIVE CODING

BACKGROUND OF THE INVENTION

1. Field of Invention

The present invention generally relates to speech coding at low bit rates (in a range 2.4–4.8 kb/s). In particular, the present invention relates to improving excitation generating and linear predicting coefficient coding directed at the reduction of the number of data bits for coded speech.

2. Description of Related Art

Digital speech communication systems including voice storage and voice response facilities utilize signal compression to reduce the bit rate needed for storage and/or transmission. As it is well known in the art, a speech pattern contains redundancies that are not essential to its apparent quality. Removal of redundant components of the speech pattern significantly lowers the number of bits required to synthesize the speech signal. A goal of effective digital speech coding is to provide an acceptable subjective quality of synthesized speech at low bit rates. However, the coding must also be fast enough to allow for real time implementation.

One method used to partially achieve these goals is based on the standard Linear Prediction (LP) technique. The characteristic features of this technique are the following. The sampled and quantized speech signal is partitioned into successive intervals (frames), then a set of parameters representative of the interval speech is generated. The parameter set includes linear prediction coefficients (LPCs) which determine an LP filter, and the best excitation signal. The best LPCs and excitation are then used to produce a synthesized signal close to the original speech signal. This is done on a per frame basis.

The best excitation is typically found through a look-up in a table, or codebook. The codebook includes vectors whose components are consecutive excitation samples. Each vector contains the same number of excitation samples as there are speech samples in a frame.

One of the most effective approaches of this type is the Code Excited Linear Prediction (CELP) method which was disclosed in "Predictive Coding of Speech at Low Bit Rates", Atal B.S., IEEE Transactions on Communications, vol. COM-30, No. 4, (April, 1982), 600–614.

FIG. 1 illustrates how a CELP implementation generates the best excitation for an LP filter such that the output of the filter closely approximates input speech.

In each frame the input speech signal is pre-filtered by a fixed digital pre-filter 100. Next, the pre-filtered speech is processed by linear prediction analyzer 101 to estimate the linear predictive filter A(z) of a prescribed order. Each frame is broken into a predetermined number of subframes. This allows excitations to be generated for each subframe. Each speech vector, for a given subframe, is passed through the ringing removal and perceptual weighting module 102. The speech signal is perceptually predistorted by a linear filter with the transfer function $W(z)=A(z)/A(\gamma z)$ for some $\gamma$. The output w, of module 102, is analyzed by the long-term prediction analyzer 103 to obtain a periodic (pitch) component p relating to the excitation. The best pitch excitation is found by searching the index (code word number) $I_A$ in an adaptive codebook (ACB) and computing the optimal gain factor $g_A$. These jointly minimize the squared norm $\|d\|^2$ of the vector $d=w-bg_A$, where b denotes the response of the synthesis filter $1/A(z\gamma)$ 104 excited by p. For this purpose, an exhaustive search in an ACB is performed to find the maximal value of the match function:

$$M=(w,b)^2/(b,b).$$

The optimal gain value is determined as follows:

$$g_A=(w,b)/(b,b).$$

The residual vector $u=w-b\ g_A$ from the output of adder 105 enters the stochastic codebook analyzer 108. Here the best residual excitation index $I_S$, and the optimal gain factor $g_s$, are found. These jointly minimize the squared norm $\|d\|^2$ of the error vector $d=u-rg_s$, where r denotes the response of the stochastic codebook analyzer 108's synthesis filter excited by the code word c, from the precomputed stochastic codebook 109. Using the multiplier 106, multiplier 110, and adder 107, we obtain the resulting excitation vector e for a given subframe as the following sum:

$$e=pg_A+cg_s.$$

For the CELP speech coding technique, the synthesized speech quality rapidly degrades as data rates are reduced. For example, at 4.8 kb/s, a 10-bit codebook is generally used. However, at 2.4 kb/s, the number of bits of the codebook must be decreased to 5. Since 5 bits are too small to cover many types of speech signals, the speech quality is abruptly degraded at a bit rate lower than 4.8 kb/s.

Various improvements of the CELP technique exist. These techniques attempt to provide acceptable speech compression at data rates below 4800 bps. Such techniques are reported in the following references:

Zinser R. L., Koch S. R. "CELP coding at 4.0 kb/sec and below: improvements to FS-1016." Proceedings of the 1992 IEEE International Conference on Acoustics, Speech, and Signal Processing, pp. I-313 through I-316, March 1992;

Wang S., Gersho A. "Improved phonetically-segmented vector excitation coding at 3.4 kb/s." Proceedings of the 1992 IEEE International Conference on Acoustics, Speech, and Signal Processing, pp. I-349 through I-352, March 1992;

J. Haagen, H. Nielsen, S. D. Hansen "Improvements in 2.4 kb/s high-quality speech coding." Proceedings of the 1992 IEEE International Conference on Acoustics, Speech, and Signal Processing, pp. II-145 through II-148, March 1992;

R. L. Zinser "Hybrid switched multi-pulse/stochastic speech coding technique." U.S. Pat. No. 5,060,269;

Z. Xiongwei and Chen Xianzhi "A new excitation model for LPC vocoder at 2.4 Kb/s." Proceedings of the 1992 IEEE International Conference on Acoustics, Speech, and Signal Processing, pp. I-65 through I-68, March 1992;

Federal Standard 1016, "Telecommunications: Analog to Digital Conversion of radio voice 4,800 bit second Code Excited Linear Prediction (CELP)." February, 1991.

These CELP-based systems reduce the bit rate by: 1) reducing the number of bits for excitation coding by using more simple excitations than in CELP; or 2) reducing the number of bits for LPC coding by more complicated vector quantization, with a corresponding loss in the subjective quality.

Use of the excitation classes other than CELP, and requiring the reduced number of bits, were investigated, for example, in "On reducing the bit rate of a CELP-based speech coder", Y. J. Liu, Proceeding of 1992 International Conference on Acoustics, Speech and Signal Processing, pp. I-49 through I-52, March 1992. It was shown there that the signal-to-noise ratio (SNR) for the half-rate CELP-based system is lower by 3–4 dB in comparison with the SNR of the Federal 4800 bps CELP Standard.

To decrease the number of bits for LPC coding, a number of methods were proposed in prior art, as for example in U.S. Pat. Nos. 5,255,339, 5,233,659. The most effective approaches of this type are split-vector quantization, disclosed in "Efficient Vector Quantization of LPC Parameters at 24 bits/frame," K. K. Paliwal and B. S. Atal, Proceedings of the 1991 IEEE International Conference on Acoustics, Speech and Signal Processing, pp. 661–664, May 1991, and the finite-state vector quantization, was described in "Finite-state Vector Quantization over Noisy Channels and its Application to LSP Parameters", Y. Hussain and N. Farvardin, Proceedings of the 1992 IEEE International Conference on Acoustics, Speech and Signal Processing, pp. II-133 through II-136, March 1992. For these processes, 24–26 bits/frame are needed for quantization with a quality close to that in CELP. However, a further decrease in the number of bits leads to a loss in the quality. Also, these quantization schemes are much more complicated in comparison with the 34 bits scalar quantizer in CELP Standard.

An effective speech compression at rates in a range 2.4 through 4.8 kb/s, with an acceptable quality of synthesized speech, and a practical real time implementation still remains as a key problem.

An improved method and apparatus for compressing speech is desired.

SUMMARY OF THE INVENTION

An improved method and apparatus for compressing speech is described. One goal of the present invention is to provide high quality speech coding at data rates approximately between 2400–4800 bits per second. Another goal is to provide such a system that also satisfies time and memory requirements of a real time hardware implementation.

In one embodiment, the following three search modes, for excitation vector generating, are used: 1) a pulses search (Pulse); 2) a full adaptive codebook search (ACB), and 3) a shortened adaptive codebook search coupled with a stochastic codebook search (SACBS). The use of these search modes reduces the number of bits required for excitation coding.

Another embodiment includes a method for constructing specially shaped pulses. The specially shaped pulses have spectrums matched with linear prediction filter parameters to improve the subjective speech quality of the synthesized speech. This technique provides a plurality of excitation forms without using additional bits for excitation coding.

Another embodiment of the invention includes a low-complexity predictive coding process for LPCs. The process includes linear prediction of LSPs followed by LSP-differences variable rate coding. This embodiment has the advantage of providing a lower data rate without degrading the LSP representation accuracy.

In another embodiment, a multi-mode code excited linear predictive (MM-CELP) speech coding lowers the data rate further. The lower data rate is achieved without substantially increasing the computational time, and complexity, of the encoding. The quality of MM-CELP synthesized speech, at a rate $\leqq$2400 bps, works well for normal uses of encoded speech.

Although a great deal of detail has been included in the description and figures, the invention is defined by the scope of the claims. Only limitations found in those claims apply to the invention.

BRIEF DESCRIPTION OF THE DRAWINGS

The present invention is illustrated by way of example, and not limitation, in the figures. Like references indicate similar elements.

DESCRIPTION OF THE PREFERRED EMBODIMENT

OVERVIEW

Figure 1:
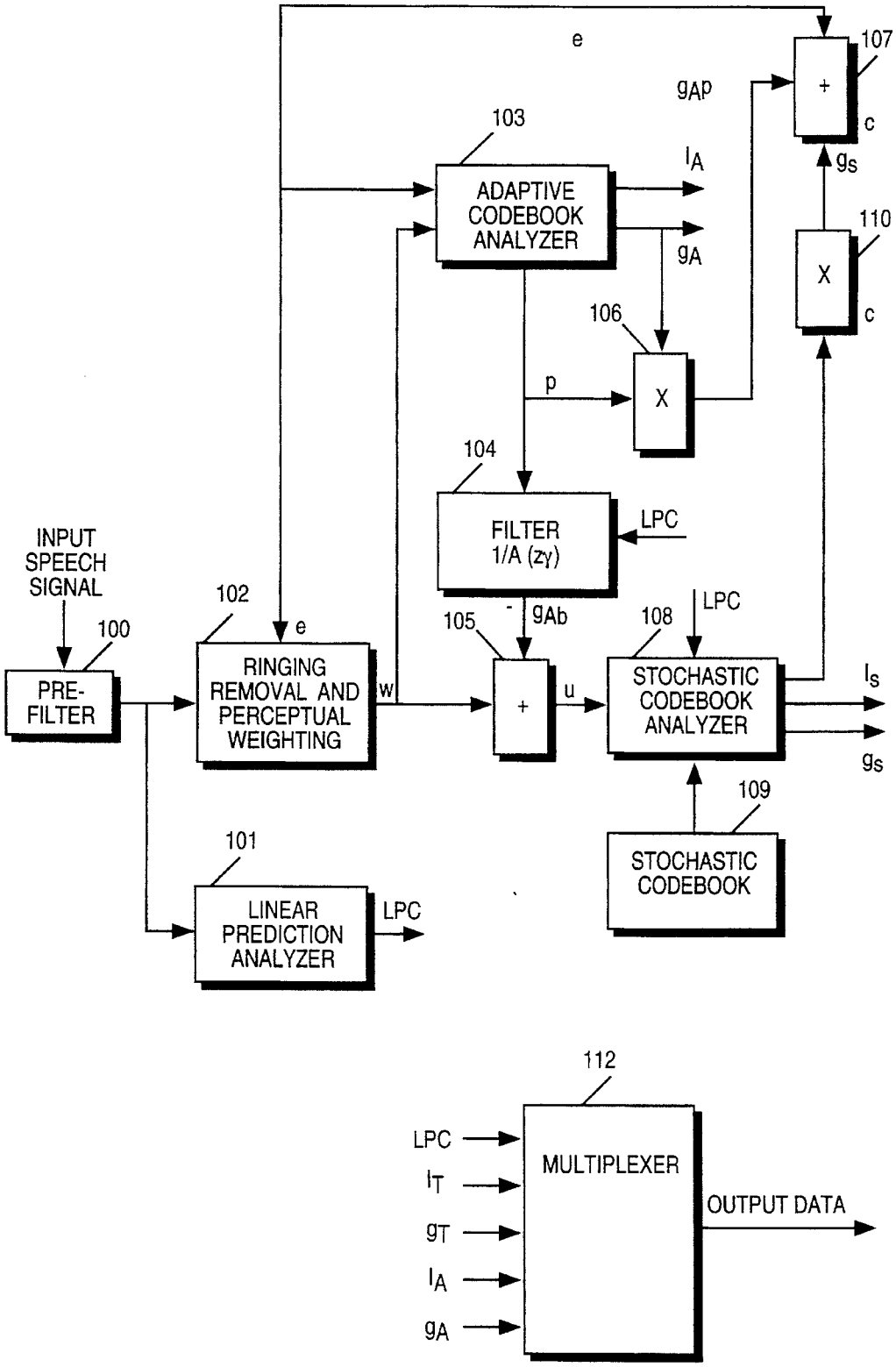
FIG. 1 (PRIOR ART)
FIG. 1 (prior art) is a block diagram of CELP speech analyzer.

An improved method and apparatus for compressing speech are described. In the following description, numerous specific details are set forth such as weighting values, mode selections, etc., in order to provide a thorough understanding of the present invention. It will be obvious, however, to one skilled in the art that the present invention may be practiced without these specific details. In other instances, well-known circuits, structures and techniques have not been shown in detail in order not to unnecessarily obscure the present invention.

APPLICATIONS OF COMPRESSED SPEECH

The present invention has application wherever speech compression or synthesized speech is used. Speech compression compresses the speech into as small a representation of the speech as possible. Speech synthesis reconstructs the compressed speech into as close a representation of the original speech as possible. Speech compression is used in voice communications, multimedia computer systems, answering machines, etc. Speech synthesis may be used in toys, games, computer systems, and so on.

In some applications, the compressed speech will be created on one system and reproduced on another. For example, a game, or toy, with predetermined audible responses, will only decode synthesized speech. Thus, given the description herein, one skilled in the art will understand that the present invention can be used in any application requiring speech compression or synthesized speech.

MULTI-MODE CELP (MM-CELP) SPEECH ANALYZER OVERVIEW

Compared to the Code Excited Linear Prediction (CELP) analyzer, one embodiment of the present invention reduces the number of bits needed for speech storing, or transmitting, without a significant loss in the subjective speech quality. These advantages are achieved by: using three different excitation search modes, instead of two modes employed in CELP, together with a special strategy of mode selection, and by using an efficient LPC coding.

In CELP, two modes (Adaptive codebook search and Stochastic codebook search) are searched for each subframe. The present speech compression technique uses the best selected candidate from a set of admissible modes that is formed on the basis of three different modes. The number of bits is reduced, compared with CELP, since only one mode is used for each subframe. As well, we improve speech quality by using a greater number of excitation forms.

In one embodiment, a set of admissible modes is determined based upon the mode used in the previous subframe. In another embodiment, the mode requiring the lowest number of bits is tested first. In another embodiment, the use of weighting coefficients are used to weight the selection of a mode, making some modes more likely than others.

In another embodiment, a substantial improvement of the system performance is obtained by effective variable rate encoding of predictive filter parameters and by a new method of constructing specially shaped pulses used in a pulse excitation mode.

Throughout the following description, many signals are processed using a number of filters, circuits, and lookup tables. Each of these can be implemented in any number of physical devices. For example, look-up tables can be implemented using DRAM or SRAM and control circuitry. Filters, for example, can be implemented in hardware (such as PLAs, PALs, PLDs, ASICs, gate-arrays) or software. Given the description of each of the devices herein, one of ordinary skill in the art would understand how to build such devices.

BLOCK DIAGRAM OF A MULTI-MODE CELP SPEECH ANALYZER

Figure 2A:
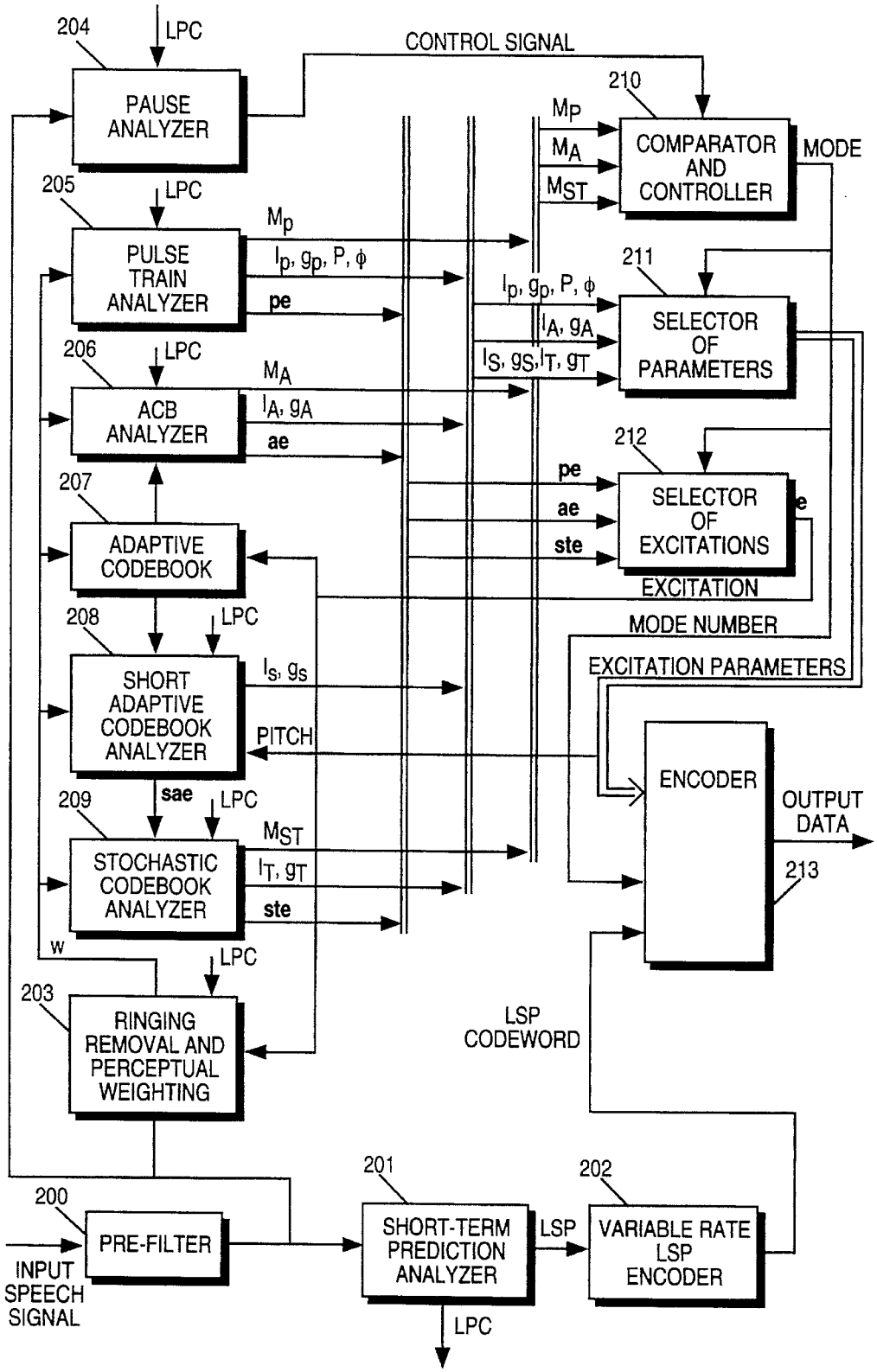
FIG. 2A is a block diagram of a speech analyzer utilizing Multi-Mode Code Exciting and Linear Prediction (MM-CELP).

The block diagram in FIG. 2A shows an implementation of a Multi-Mode CELP (MM-CELP) speech analyzer. Details relating to the analog to digital conversions are omitted as one of ordinary skill in the art would understand how to effect such conversions given the description herein. The digital speech signal, which is typically sampled at 8 KHz, is first processed by a digital pre-filter 200. The purpose of such pre-filtering, coupled with the corresponding post-filtering, is to diminish specific synthetic speech noise. See Ludeman, Lonnie C., "Fundamentals of Digital Signal Processing," New York, N.Y.: Harper and Row, 1986, for further background on pre-filtering and post-filtering.

Pre-filtered speech is analyzed by short-term prediction analyzer 201. Short-term prediction analyzer 201 includes a linear prediction analyzer, a converter from linear prediction coefficients (LPC) into line spectrum pairs (LSPs) and a quantizer of the LSPs. For each frame, linear prediction analyzer 201 produces a set of LPCs $a_l, \ldots, a_m$ which define the LP analysis filter of a prescribed order m (called a short-term prediction filter):

$$A(z)=1-a_1z^{-1}-a_2z^{-2}-\ldots-a_mz^{-m}.$$

Generally, a filter order of 10 or more is acceptable. Typically, the linear prediction analysis is performed for each speech frame (about a 30 millisecond duration). The LPCs for each subframe can be produced by a well known interpolation technique from the LPCs for each frame. This interpolation is not necessary, however, it does improve the subjective quality of the speech.

The LPCs for each frame are converted into m line spectrum frequencies (LSF), or line spectrum pairs (LSP), by LPC-to-LSP conversion. This conversion technique is described, for example, in "Application of Line-Spectrum Pairs to Low-Bit-Rate Speech Encoders", by G. S. Kang and L. J. Fransen, Naval Research Laboratory, at Proceedings ICASSP, 1985, pp. 244–247. Independent, nonuniform scalar quantization of line spectrum pairs is performed by the LSP quantizer. The quantized LSP output, of short-term prediction analyzer 201 is processed through the variable rate LSP encoder 202, into codewords of a predetermined binary code. The code has a reduced number of spectral bits, for transmission into a channel or memory.

The frame, consisting of N samples, is partitioned into subframes of L samples each. Therefore the number of subframes in a frame is equal to N/L. The remaining speech analysis is performed on a subframe basis. In a typical implementation, the number of subframes is equal to 2, 3, 4, 5 or 6.

In one embodiment, the tinging removal and perceptual weighting module 203, is the same as that described in CELP. This unit performs two functions. First, it removes ringing caused by the past subframe synthesized speech signals. This function results in the ability to process speech vectors for different subframes independently of each other. Second, ringing removal and perceptual weighting module 203 performs the perceptual weighting of speech spectral components. The main purpose of perceptual weighting is to reduce the level of the synthesized speech noise components lying in the most audible spectral regions between speech formants. (A formant is a characteristic frequency, a resonant frequency, of a person's voice). As in CELP, perceptual weighting is realized by passing the pre-filtered speech signals through the weighting filter (WF)

$$W(z)=A(z)/A(\gamma z),$$

with a parameter $\gamma$, taken from a range between 0.8 and 1.0. The output, w, of ringing removal and perceptual weighting module 203 is the perceptually predistorted speech.

To construct the excitation vectors for the synthesis linear predictive filter 1/A(z), the following three search modes are used: the full adaptive codebook search (ACB); the pulses search (Pulse); the shortened adaptive codebook search coupled with the stochastic codebook search (SACBS). First, the "best" excitation (in the sense of maximizing a match function) is found for each search mode and then the "best" excitation among selected candidates is searched. The match function is defined as follows:

$$M=(w,f)/(f,f),$$

where f=f(e) denotes the excitation candidate filtered by a zero-state response filter 1/A(z$\gamma$). Maximizing match function M is equivalent to minimizing the Euclidean distance between the predistorted speech w, and filtered (and scaled by gain factor) excitation f. So, this procedure provides the maximum of the perceptual weighted signal to noise ratio.

The output w, of the ringing removal and perceptual weighting module 203, is passed to the pulse train analyzer 205, the ACB analyzer 206, the short adaptive codebook analyzer 208, and the stochastic codebook analyzer 209.

The pulse train analyzer 205, generates a list of specially shaped pulses. It also determines the best pitch (P), the best starting position (phase $\phi$), the best gain ($g_P$) and the index of the best specially shaped impulse ($I_P$) for the multiple pitch spaced pulses excitation. The outputs of the pulse train analyzer 205 are the best excitation vector pe, its parameters ($I_P$, $g_P$, P, $\phi$), and the maximal value of match function $M_P$.

Note however, that if bit rates of approximately 4000 bps are permissible, in a given application of the present embodiment, then other pulse trains may be used rather than specially shaped pulses. For example, a pulse train having pulses positioned at specific points and with specific amplitudes can be used. The set of parameters includes (gpi, $t_i$), i=1, 2, . . . , k, where gpi denotes the gain of the i-th pulse of the pulse train and $t_i$ denotes the position of the i-th pulse, k is the number of pulses in the pulse train.

The ACB analyzer 206 is implemented as it was described for the CELP Standard FS-1016. The adaptive codebook 207 includes excitations e used for previous subframes. For a given subframe, ACB analyzer 206 generates the best adaptive codebook excitation, ae, its corresponding index value ($I_A$) in adaptive codebook 207, and a gain $g_A$.ae represents the excitation vector that maximizes the match function $M_A$.

Short adaptive codebook analyzer (SACB) 208 differs from ACB analyzer 206 in searching for the best excitation. SACB determines its best (sae), the corresponding index ($I_S$), and gain ($g_S$), through a subset of the adaptive codebook 207 called the shortened ACB. In this case, the index ($I_S$) and the gain ($g_S$) have a reduced quantization scale. The shortened ACB includes past excitation vectors, however, the indices are neighbors of the pitch value found in the previous subframe analysis (previous output of the selector 211). This pitch value is determined as follows:

$$\text{Pitch} = \begin{cases} P, \text{ if the previous Mode} = \text{Pulse} \\ \text{Pitch}(I_A), \text{ if previous Mode} = ACB \\ \text{Pitch}(I_S), \text{ if previous Mode} = SACBS \end{cases},$$

where Pitch($I_A$) and Pitch($I_S$) are some functions mapping integer values $I_A$ and $I_S$ onto a set of the available pitch values.

The best shortened ACB excitation vector sae, scaled by factor $g_S$, is processed by the stochastic codebook (SCB) analyzer 209 to reduce the difference between the SACB module output and the perceptual predistorted speech vector w. In one embodiment, the stochastic codebook (SCB) analyzer 209 is the same as in the CELP standard.

To reduce the computational complexity of the search through the SCB, SCB analyzer 209 may be implemented as a trellis codebook, as was disclosed in Kolesnik et. al. "A Speech Compressor Using Trellis Encoding and Linear Prediction", U.S. patent application Ser. No. 08/097,712, filed Jul. 26, 1993. Such a computational complexity reduced system is referred to as a Multi-Mode Code Exciting and Linear Prediction (MM-TELP) speech encoding system.

Stochastic codebook analyzer 209 calculates the difference signal, u, between a perceptually predistorted speech vector, w, and the response of the synthesis filter 1/A(z$\gamma$) excited by $g_S$·sae. This difference signal u is approximated by a zero-state response of the SCB analyzer synthesis filter excited by a word found in the stochastic codebook. The transfer function of this filter could also be chosen as B(z)=1/A(z$\gamma$).

The best code word, c, as well as its index, $I_T$, and optimal gain value, $g_T$=$g_T$(u,c), are found by performing the decoding procedure in the SCB analyzer 209. The excitation vector ste=$g_T$c+sae, together with the SCB index $I_T$ and the optimal gain $g_T$, are transferred to the output of the stochastic codebook analyzer 209. Next, stochastic codebook analyzer 209 calculates the match function, $Ms_T$, for the sum of the best scaled vectors from the shortened adaptive codebook and the SCB. The value of the match function $Ms_T$ is also transferred to the output of the stochastic codebook analyzer 209.

The pause analyzer 204 uses an energy test to classify each subframe to determine whether that subframe is a silent, or a voice activity, subframe. The pause analyzer 204 output controls the comparator and controller 210. In one embodiment, at a subframe, following a silent subframe, only pause or pulse search modes are allowed. For the voice activity subframe, comparator and controller 210 chooses search modes depending on the mode of the previous subframe.

Since different excitation search modes require differing numbers of bits for excitation coding, the bit rate value is variable from frame to frame. The largest number of bits is required by SACBS mode while the smallest ACB mode is required. To reduce, or to limit, the bit rate, without a substantial loss in speech quality, some restrictions on the search mode usage may be imposed optionally. Admissible modes which may be chosen depending on the previous selected modes are presented in Table 1.

TABLE 1

| Mode for Previous Subframe | Admissible Modes for Current Subframe |
|---|---|
| Pulse | Pulse, ACB, Pause |
| ACB | Pulse, SACBS, Pause |
| SACBS | Pulse, ACB, Pause |
| Pause | Pulse, Pause |

For a voice activity subframe, the comparator and controller 210 selects the search mode using the formula $$\text{Mode}-\arg\max\{\beta\mu M\mu\}\mu\epsilon M$$

where M is a set of admissible modes, M $\subset$\{P, ACB, SACBS\}, $M_\mu$ denotes the match function for mode $\mu$, and $\beta_\mu$ are weighting coefficients. These weighting coefficients effect the probability that a certain mode will be chosen for a given subframe. Through empirical study, the weighting coefficient of Table 2 have been found to provide subjectively good quality speech with a minimum average data rate.

TABLE 2

| Search mode | Weighting Coefficient |
|---|---|
| Pulse | 0.7–1.0 |
| ACB | 1.1–1.3 |
| SACBS | 0.8–1.0 |

Weighting coefficients $\beta\mu$ are introduced with two goals: a) to reduce the synthesized noise level and b) to provide more flexible bit rate adjustment.

The selector of excitations 212, and the selector of parameters 211, choose respectively, the best excitation e, and its corresponding parameters, for the selected search mode. The best excitation vector e, the output of selector of excitations 212, is used for the innovation of the ACB content, in a similar manner as the CELP standard analyzer. The excitation vector e is additionally supplied to perceptual weighting and ringing removal 203.

The excitation parameters and the search mode for each subframe, in a frame, as well as the coded LSP, for a given frame, are jointly coded by the encoder 213 and are transmitted to a receiving synthesizer, or stored in a memory.

Bit rate reduction is also achieved through the use of a superframe. A superframe consists of a few frames and can be used to restrict the number of times a mode having a large numbers of bits (e.g. SACBS and Pulse) can be used in that superframe.

DETAILS OF THE PERCEPTUAL WEIGHTING AND RINGING REMOVAL CIRCUIT

Figure 2B:
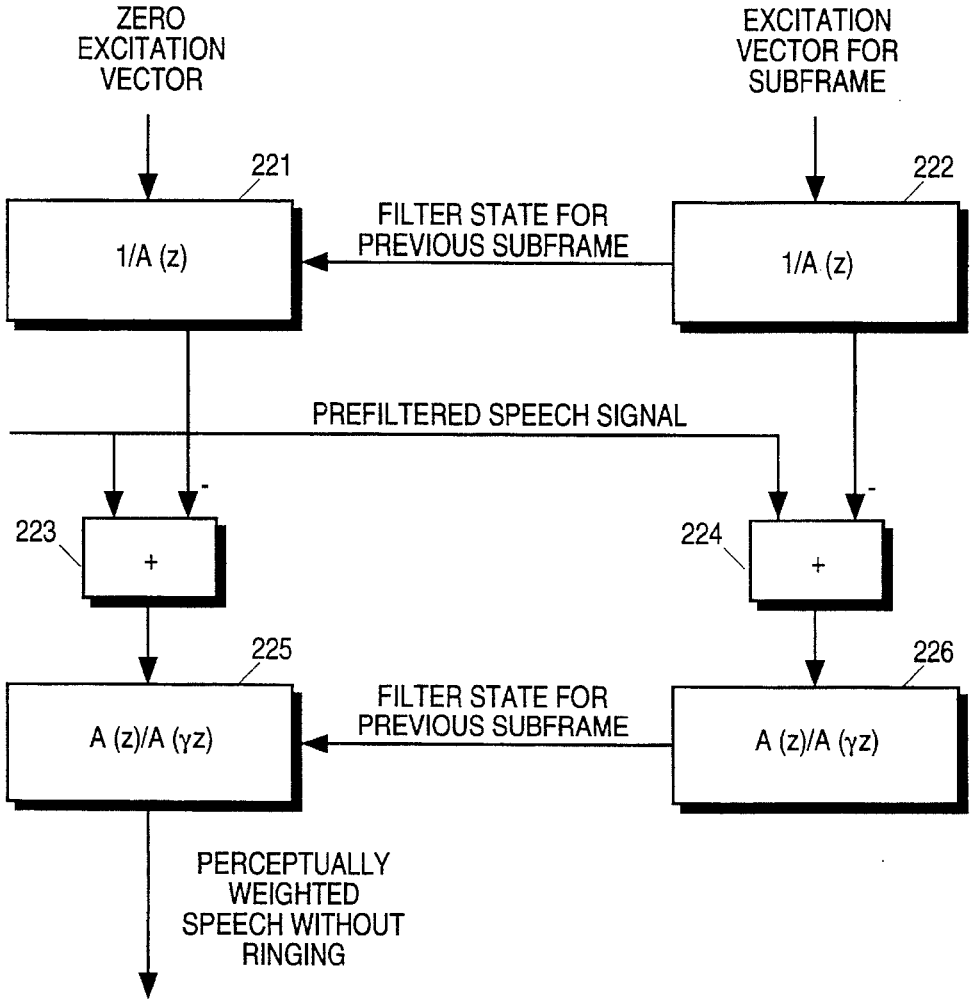
FIG. 2B is a block diagram of the perceptual weighting and ringing removal unit from the MM-CELP speech analyzer of FIG. 2A.

The ringing removal and perceptual weighting module 203, of FIG. 2A, is further described with reference to FIG. 2B. There are two synthesis filters 1/A(z) 221, 222, and two weighting filters 225, 226. The excitation vector e, from the previous subframe, is applied to the filter 222, in order to produce a synthesized speech vector for the current subframe. The zero excitation vector is applied to the filter 221, starting from the state achieved by the filter 222 to the end of the previous subframe, in order to produce the ringing vector for the current subframe. The output of the adder 224 is the approximation error vector. The output of the adder 223 is the speech vector without ringing. The approximation error vector is applied to the filter 226 starting from the state achieved to the end of the previous subframe. The filter 225 uses the same state as achieved by the filter 226 to the end of the previous subframe to produce the perceptually weighted speech vector without ringing for the current subframe.

DETAILS OF THE PULSE TRAIN ANALYZER

Figure 3A:
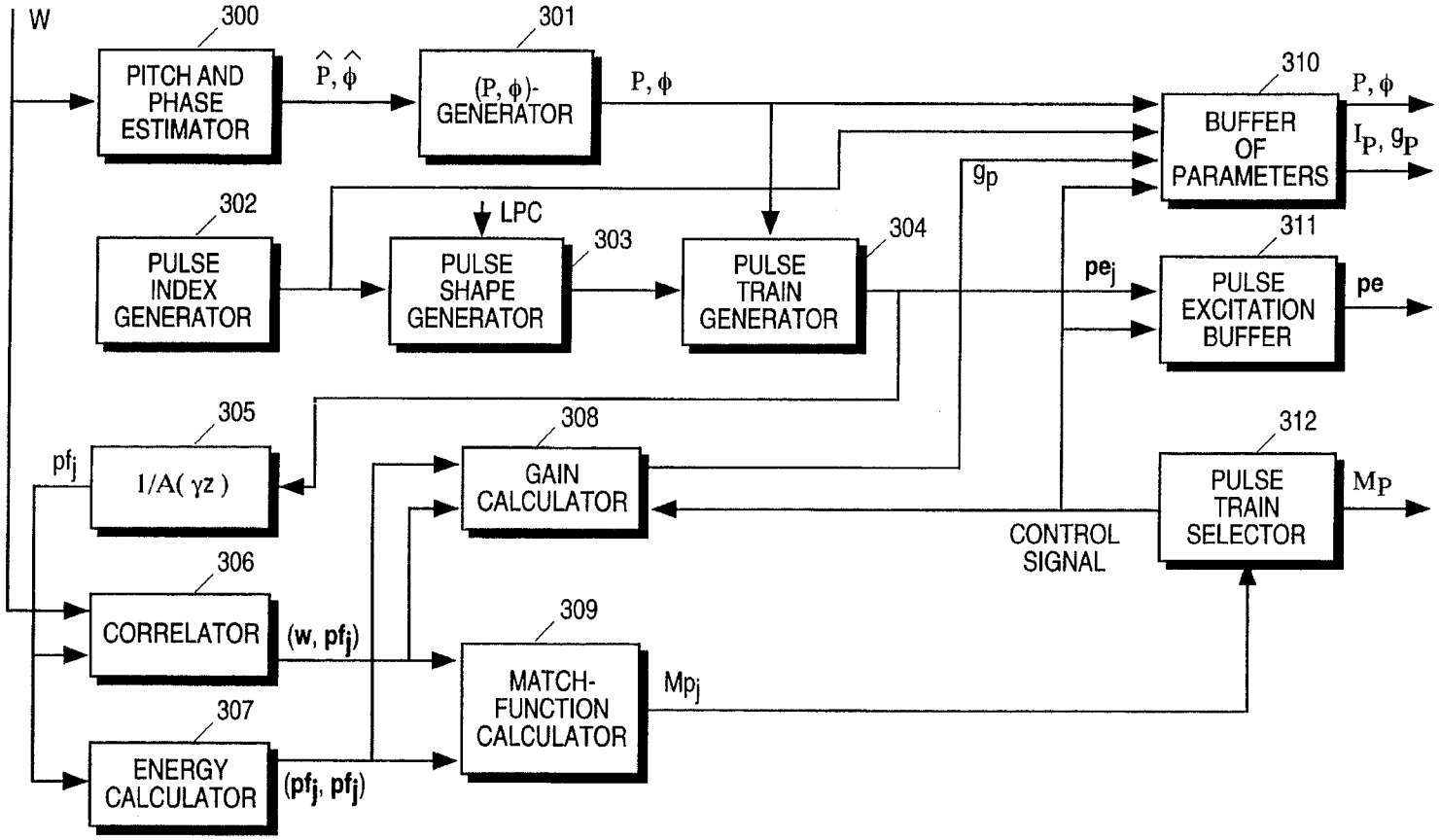
FIG. 3A is a block diagram of the pulse analyzer of FIG. 2A.
Figure 3B:
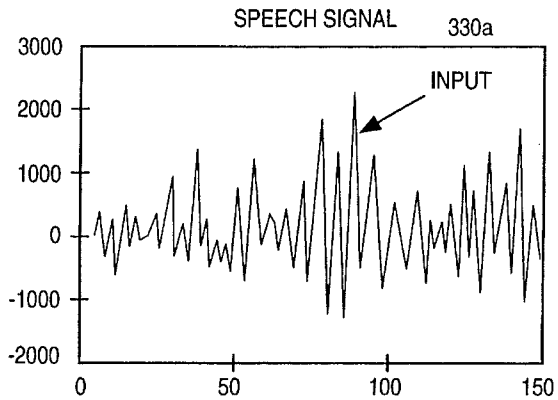
FIGS. 3B, 3C, 3D, and 3E is an example of a specially shaped pulse depending on the speech waveform as may be used in one embodiment of the present invention.
Figure 3D:
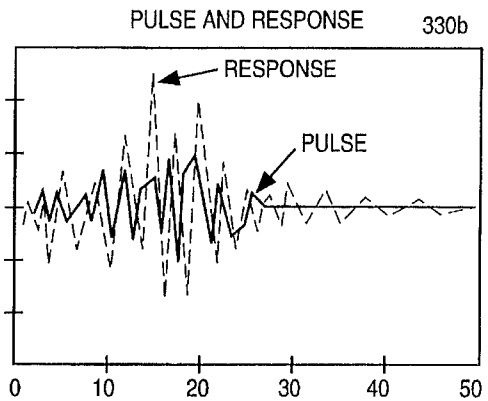
Figure 3C:
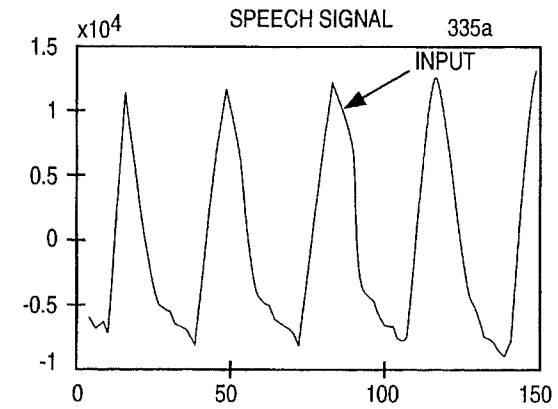
Figure 3E:
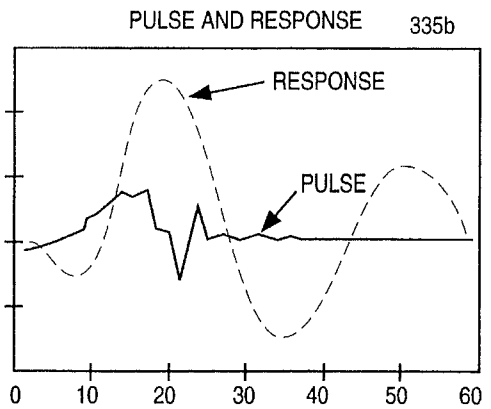

Referring now to FIG. 3A, the organization of the pulse train analyzer 205 is presented in greater detail. Here the pitch and phase estimator 300 computes initial pitch ($\hat{P}$) and phase ($\hat{\phi}$) estimates by analyzing the perceptually weighted speech signal from the ringing removal and perceptual weighting module 203. These values are used as the inputs of the pitch and phase generator 301 which forms a list of the pitch and phase values in the neighborhood of $\hat{P}$ and $\hat{\phi}$ respectively. The neighborhood is defined by an approximation of $\hat{P}$ and $\hat{\phi}$ used to decrease the computation time needed to calculate these values.

The pulse index generator 302 prepares a list of the pulse shape indices for the pulse shape generator 303. The index value from the output of pulse index generator 302, together with the pitch and phase values from the pitch and phase generator 301, are temporarily stored in the buffer of parameters 310.

The list of pitch and phase values, together with the list of pulse indices, are used in a search for the best pulse excitation. The pulse train generator 304, employing the pitch P and phase $\phi$ values from pitch and phase generator 301, and the specially shaped pulse $v_j(\bullet)$ from pulse shape generator 303, generates the excitation vector $pe_j$ in the form of multiple pitch spaced pulses. This excitation vector may be represented as follows:

$$pe_j(t) = \sum_{i=1}^{[L/P]} v_j(t - \phi - iP - \tau_j),$$

where $v_j(\bullet)$ is the j-th specially shaped pulse. L is the subframe length. [•] denotes the maximal integer less than, or equal to, the enclosed number. $\tau_j$ is the number of central position of the j-th pulse. P is the pitch.

This vector is temporarily saved in the pulse excitation buffer 311. $pe_j$ also passes through a zero-state perceptual synthesis filter 305, to produce the filtered vector $pf_j$. For vector, $pf_j$, the correlation (w, $pf_j$) is computed in the correlator 306. The energy ($pf_j$, $pf_j$) is computed in the energy calculator 307. The match function calculator 309 uses these correlation and energy values to compute the pulse mode match function $$M_{pj}=(w,pf_j)^2/(pf_j,pf_j).$$

The pulse train selector 312 finds the maximal value of the match function $M_{pj}$ over all possible pulse trains, and produces a corresponding control signal for gain calculator 308, buffer of parameters 310, and pulse excitation buffer 311. This control signal is used for saving the best pulse excitation vector pe in the pulse excitation buffer 311, and for saving its parameters, (index, pitch, phase), in the buffer of parameters 310. The control signal from the pulse train selector 312 also allows the gain calculator 308 to generate the optimal gain value $gp=g_{pj}$ for the best pulse train, using the formula $g_P=(w, pf_j)/(pf_j, pf_j)$.

At the end of the search, the best pulse excitation pe, as well as its parameters ($I_P$, P, $\phi$, $g_P$), and the best match function value $M_P$, are passed to the output of the pulse train analyzer 205.

Now, the implementation of the special pulse shape generator 303 is considered in more detail. The main goal of the special pulse shape generator 303 is to improve the subjective speech quality. For this purpose, the special pulse sequence $v=(v_1, v_2, \ldots, v_M)$, of length M, is used instead of an ordinary delta-pulse with uniform frequency distribution. This impulse has the spectrum matched with the synthesis filter frequency response. The specially shaped pulse v is constructed using the LP analysis filter by the following process.

Given vector $x=(x_0, x_1, \ldots)$, let $X(z)=x_0+x_1z^{-1}+\ldots$ We denote by $X_{i,j}(z)$ the polynomial $X_{i,j}(z)=x_iz^{-i}+x_{i+1}z^{-(i+1)}+\ldots+x_jz^{-j}, j>i$. Let $$U(z)=(1-\delta z^{-1})/A(\alpha z),$$

where A(z) denotes the Z-transform for the LP filter, $\alpha$, $\delta$ are empirically chosen constants, $0\leqq\alpha$, $\delta\leqq 1$. Then the samples $v_0, v_1, \ldots, v_{n-1}$, $n<M$, representing the first n positions of the pulse v, are generated by the formula $V_{0,n-1}(z)=z^{n-1}U_{0,n-1}(z^{-1})$, i.e. by the time inversion of the pulse response $u=(u_0, u_1, \ldots, u_{n-1})$. To obtain the rest of the samples $v_n, v_{n+1}, \ldots, v_M$ we find $$W(z)=(V_{n-m,n-1}(z)+z^{-n}U_{0,d}(z))A(\beta z)$$

and put $$V_{n,M-1}(z)=W_{n,M-1}(z),$$

where $0\leqq\beta\leqq 1$ is an empirically chosen constant, $d\geqq 0$ is a fixed constant. Coefficients $\alpha$ in the range 0.9 . . . 0.98, $\delta$ in the range 0.55 . . . 0.75, and β in the range 0.6 . . . 0.8, were chosen using a large speech database to provide acceptable subjective speech quality. The described process provides the natural synthesized speech quality, and saves bits needed for pulse index encoding in the conventional pulse codebook.

A MM-CELP METHOD OF ENCODING SPEECH

Figure 2C:
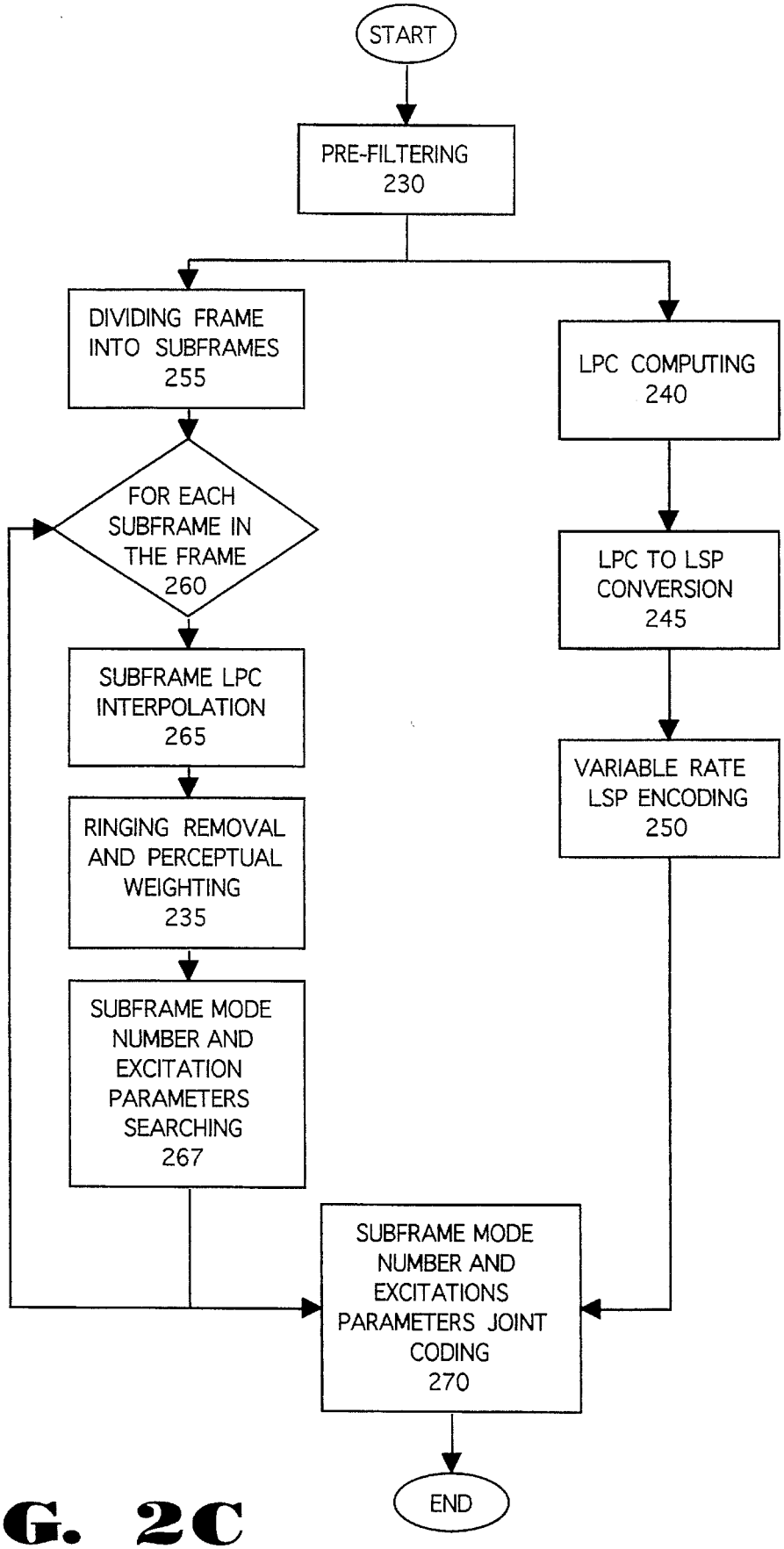
FIG. 2C is a flowchart illustrating one embodiment of a method of Multi-Mode Code Exciting and Linear Prediction (MM-CELP) speech encoding.

FIG. 2C is a flowchart illustrating one embodiment of a method of Multi-Mode Code Exciting and Linear Prediction (MM-CELP) speech encoding. It is clear from the description below, that some of these operations can be run in parallel. This invention is not limited to the order of steps presented in FIGS. 2C and 2D.

At 230, the input speech signal is pre-filtered (pre-filter 200).

At 240, the LPCs for the frame are generated in the short-term prediction analyzer 201. As well, at 245, short-term prediction analyzer, generates the LSPs for the frame. At 250, variable rate LSP encoder 202 variable rate encodes the LSPs for the frame.

At 255, the frame is divided into a number of subframes (typically four). For each subframe, the following steps are executed, 260. At 265, the LPCs for the subframe are interpolated by the short-term prediction analyzer 201. At 235, the pre-filtered signal and the LPC's are passed through a ringing removal and perceptual weighting module 203. At 267, the mode is selected from a number possible modes. The excitation parameters for that selected mode are also generated.

Once all the subframes are processed, using steps 260, 265, 235 and 267, the subframe mode numbers and excitation parameters are jointly coded with the LSP code word.

Figure 2D:
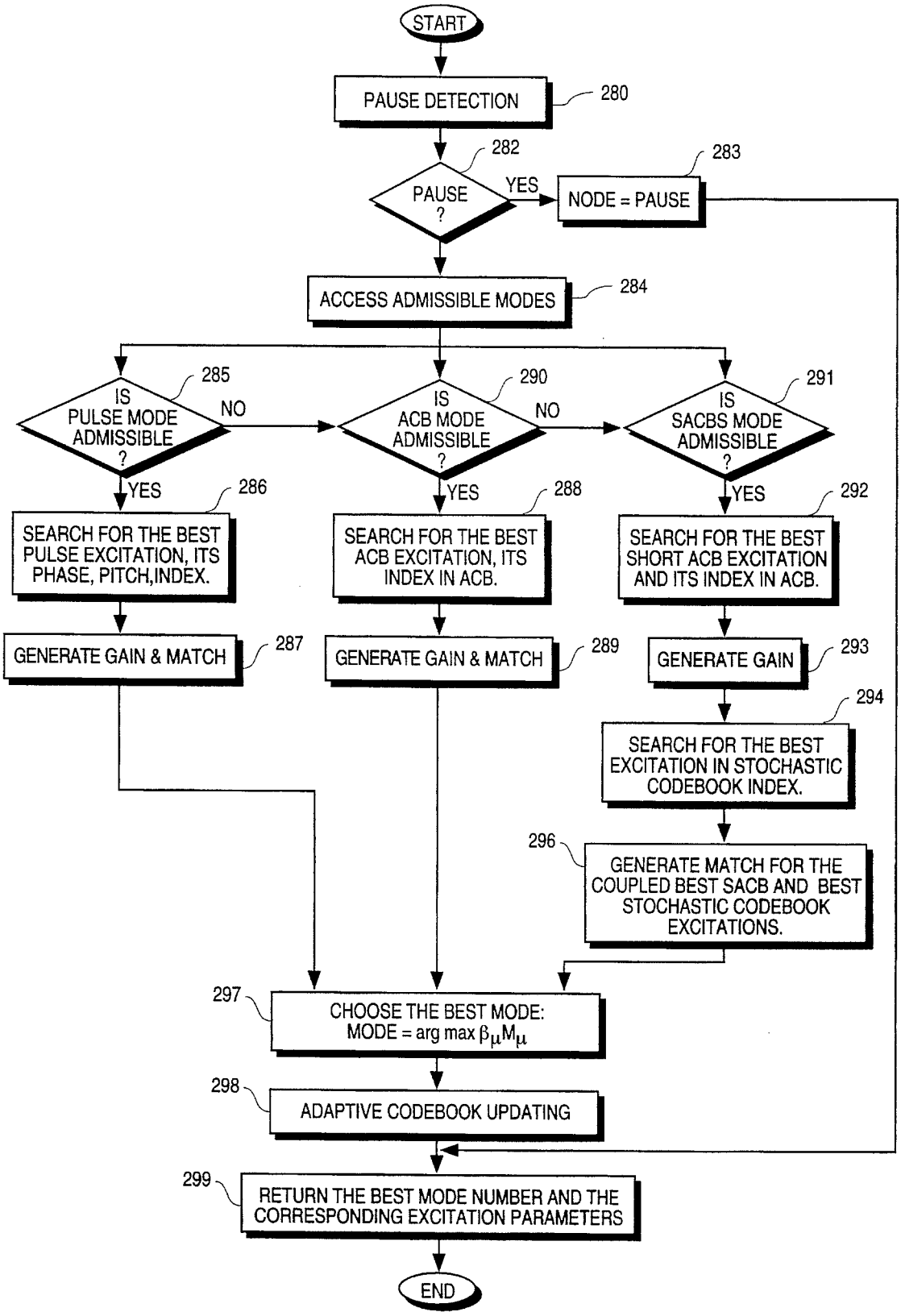
FIG. 2D is a flowchart illustrating one embodiment of a method of searching subframe mode numbers and excitation parameters.

FIG. 2D is a flowchart illustrating one embodiment of a method of searching subframe mode numbers and excitation parameters. This figure corresponds with step 267 of FIG. 2C. Note that in this figure, the execution time required for the present embodiment can be reduced by intelligently testing for a mode to correspond to the present frame. For example, the mode having the smallest number of bits (ACB) can be tested before the other modes. If the tested mode provides a sufficiently small mean-square error, the rest of the modes will not be tested.

At 280, pause analyzer 204 determines whether the input speech contains a pause. If the speech contains a pause for the subframe, 282, then the mode is set to pause, 283. Otherwise, the other various excitations and other mode information are generated 284. In one embodiment, this information is generated by a number of circuits which generate this information regardless of whether a pause is selected.

At 285, the pulse mode information, is tested for whether this subframe can be characterized as a pulse. This determination is made depending on the previous subframe's mode (see Table 1 for more information. Table 1 always allows some modes to be selected for a subframe.). If pulse mode is acceptable, then, at 286, a search is made for the best pulse excitation. The best pulse excitation's corresponding phase, pitch and index are also generated. The corresponding gain and match values are also generated, at 287.

At 290, ACB mode is tested to determine whether it is admissible. If ACB mode is admissible, then at 288, a search for the best ACB excitation, and corresponding index, is made. At 289, the corresponding gain and match values are also generated.

At 291, SACBS mode is tested to determine whether it is permitted. If the SACBS mode is permitted, then at 292, a search for the best short ACB excitation and corresponding index is made. At 293, the gain is generated. At 294, a search for the best excitation from the stochastic codebook, and its corresponding index, is searched. At 296, a match value for the coupled best SACB and best stochastic codebook excitations is generated.

At 297, the best mode is selected from the match values provided by the various modes. The match values are also weighted prior to selection.

At 298, the adaptive codebook is updated with the excitation of the most recently selected mode. If pause is the selected mode, then the excitation from the last non-pause mode is used.

At 299, the selected mode and the corresponding excitation parameters are made available for encoding.

EXAMPLES OF SPECIALLY SHAPED PULSES

FIGS. 3B, 3C, 3D, and 3E show some examples of specially shaped pulses and corresponding pulse responses of the synthesis filter 1/A(z). The x-axis represents time units, each unit being 1/8000 of a second. The y-axis represents an integer-valued signal magnitude. Speech signal **330*a* represents an input signal to the filter. Pulse and response 330*b* represents the corresponding pulse and response signals. Speech signal 335*a* represents a different input speech signal. Pulse and response 335*b*** represents the corresponding pulse and response signals. As is clear from FIGS. 3B, 3C, 3D, and 3E for these examples, pulse shape is adopted in accordance with changes in the original speech signal.

DETAILS OF A VARIABLE RATE LSP ENCODER

Figure 4:
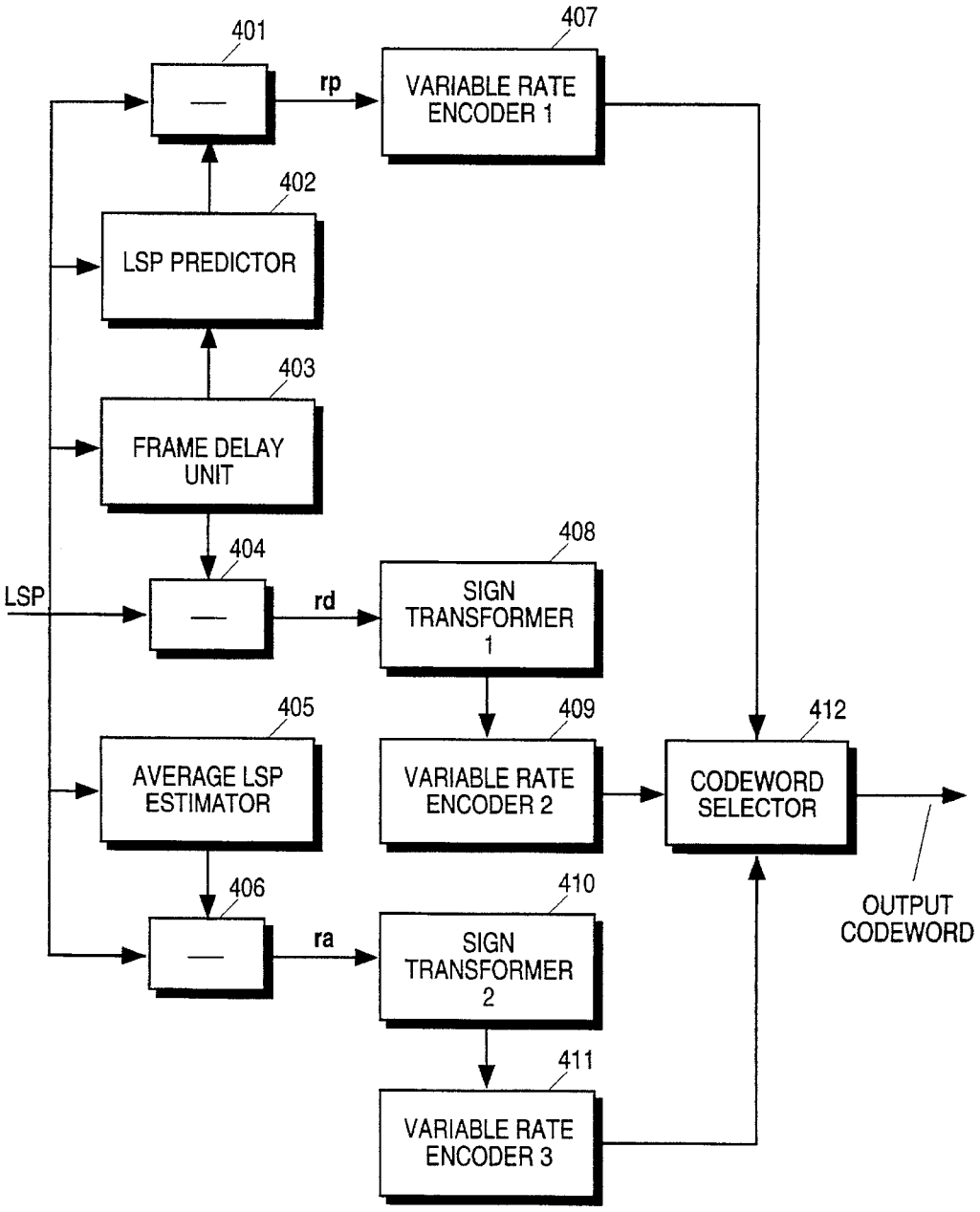
FIG. 4 is a block diagram of the LSP encoder of FIG. 2A.

FIG. 4 shows an implementation of the variable rate LSP encoder 202. The LSP encoder 202 uses m quantized LSPs and comprises three schemes for LSP predicting and preliminary coding. The first predicting and preliminary coding scheme contains the subtractor 401, the LSP predictor 402 and the variable rate encoder 1 407. The LSP predictor 402, using current LSPs and LSPs stored in the frame delay unit 403 during the previous frame, predicts the current LSPs as follows $$\hat{F}_i(t) = \sum_{j \in J_i} a_{ij} F_j(t) + \sum_{k \in k_i} b_{ik} F_k(t-1) + c_i,$$

$$i = \overline{1,m}$$

where $F_i(t)$ denotes the i-th LSP for the current frame, $F_i(t-1)$ denotes the i-th LSP for the previous frame, $\hat{F}_i(t)$ denotes the predicted i-th LSP for the current frame, a, b, c are linear prediction coefficients, $J_i, K_i$ are some sets of indices. Linear prediction coefficients, and sets of indices, are precomputed using a large speech database to minimize the mean-squared prediction error.

For example if m=10 the corresponding equations have the following form $$\hat{F}_1(t) = \text{round}(b_{11}F_1(t-1) + b_{12}F_{10}(t-1) + c_1);$$

$$\hat{F}_{10}(t) = \text{round}(a_{10,1}F_1(t) + b_{10,1}F_9(t-1) + b_{10,2}F_{10}(t-1) + c_{10});$$

$$\hat{F}_9(t)=\text{round}(a_{9,1}F_{10}(t)+b_{9,1}F_9(t-1)+b_{9,2}F_{10}(t-1)+c_9);$$

$$\hat{F}_8(t)=\text{round}(a_{8,1}F_9(t)+b_{8,1}F_8(t-1)+b_{8,2}F_9(t-1)+c_8);$$

$$\hat{F}_7(t)=\text{round}(a_{7,1}F_8(t)+b_{7,1}F_7(t-1)+b_{7,2}F_8(t-1)+c_7);$$

$$\hat{F}_6(t)=\text{round}(a_{6,1}F_7(t)+b_{6,1}F_6(t-1)+b_{6,2}F_7(t-1)+c_6);$$

$$\hat{F}_5(t)=\text{round}(a_{5,1}F_6(t)+b_{5,1}F_5(t-1)+b_{5,2}F_6(t-1)+c_5);$$

$$\hat{F}_4(t)=\text{round}(a_{4,1}F_5(t)+b_{4,1}F_4(t-1)+b_{4,2}F_5(t-1)+c_4);$$

$$\hat{F}_3(t)=\text{round}(a_{3,1}F_4(t)+b_{3,1}F_3(t-1)+b_{3,2}F_4(t-1)+b_{3,3}F(t-1)+c_3);$$

$$\hat{F}_2(t)=\text{round}(a_{2,1}F_1(t)+a_{2,2}F_3(t)+b_{2,1}F_2(t-1)+b_{2,2}F_1(t-1)+b_{2,3}F_3(t-1)+c_2);$$

where round(x) means rounding x to the nearest integer.

Note that components $F_i$ of the LSP vector depend on each other. So, each estimate $\hat{F}_i$ in the above formulae is calculated based on those components $F_i$ which are correlated with $F_i$ in the most degree. Using the exact values of $F_i$, instead of their estimates in the right side of the equations, reduces the prediction error. Formulae are ordered by the specific manner. Due to this ordering, calculations are performed in a sequence that uses prediction error values, extracted from the bit stream synthesizer, to restore the exact values $F_i$. Example prediction coefficients are given in the following Table 3.

TABLE 3

| k | $a_{k,1}$ | $a_{k,2}$ | $b_{1k}$ | $b_{2k}$ | $b_{3k}$ | $c_k$ |
|---|---|---|---|---|---|---|
| 1 | | | 0.75 | −0.10 | | 1.75 |
| 2 | 0.65 | 0.70 | 0.45 | −0.45 | −0.25 | 0.06 |
| 3 | 0.65 | | −0.15 | 0.35 | −0.15 | 0.43 |
| 4 | 0.60 | | −0.10 | 0.20 | | 1.15 |
| 5 | 0.55 | | −0.10 | 0.35 | | 1.15 |
| 6 | 0.60 | | −0.10 | 0.45 | | −0.06 |
| 7 | 0.70 | | −0.45 | 0.80 | | 1.35 |
| 8 | 0.60 | | −0.25 | 0.45 | | 1.60 |
| 9 | 0.65 | | −0.40 | 0.55 | | 1.55 |
| 10 | 0.05 | | 0.60 | −0.15 | | 2.25 |

The subtractor 401 produces the residual LSP vector rp. This is the difference vector between the current frame LSPs and the corresponding predicted LSPs. The sequence of LSP differences from the output of the subtractor 401 is component-wise encoded by some variable rate prefix code in the variable rate encoder 1 407.

The second LSP predicting and coding scheme contains frame delay unit 403, the subtractor 404, the sign transformer 1 408 and the variable rate encoder 2 409. The vector of m LSP differences, rd, is generated by subtractor 404 using the formula $$rd_i(t)=F_i(t)-F_i(t-1), i=\overline{1,m}.$$

The sign transformer 1 408 analyzes the sum of the vector rd components. If this sum is negative, sign transformer 1 408 inverts all components of the vector rd. The resulting sequence of LSP differences, from the output of sign transformer 1 408, enters variable rate encoder 2 409. Here, the sequence is component-wise coded by a variable rate prefix code.

The third predicting and coding scheme contains the average LSP estimator 405, the subtractor 406, the sign transformer 2 410 and the variable rate encoder 3 411. The vector of m LSP differences, ra at the output of the subtractor 406, is computed by the formula $$ra_i(t)=F_i(t)-\text{average}(F_i), i=\overline{1,m},$$

where average($F_i$) denotes the estimate of the average value for the i-th LSP over a previous time interval, (computed by average LSP estimator 405). The sign transformer 2 410 and the variable rate encoder 3 411 operate analogously to the sign transformer 1 408 and variable rate encoder 2 409 respectively. Generally, encoders 409 and 411 may use the same Huffman code, which differs from the code used by the encoder 1 407. The Huffman codes are precomputed using a large speech database.

At the output of the variable rate encoder 1 407 we have the codeword of length $$L_p=\sum_{i=1}^{m} l_i+N_p,$$

where $l_i$ denotes the codeword length for the i-th component of the vector rp, Np is the number of bits for indicating which predicting scheme has been used.

The outputs of the encoders 409 and 411 are the codewords of lengths $$L_D=\sum_{i=1}^{m} l_i+1+N_D, \text{ and } L_A=\sum_{i=1}^{m} l_i+1+N_A,$$

respectively. One additional bit is needed for pointing to sign inversion, $N_D$ and $N_A$ are the numbers of bits for indicating that the predicting scheme has been used. In one embodiment, the encoding scheme bits have been chosen to be Np=1, $N_A$=2 and $N_D$=2.

The codeword selector 412 finds min{$L_P$, $L_D$, $L_A$}, and the codeword with minimal length, is transferred by selector 412, to the output of the variable rate LSP encoder 202.

A SPEECH SYNTHESIZER

Figure 5:
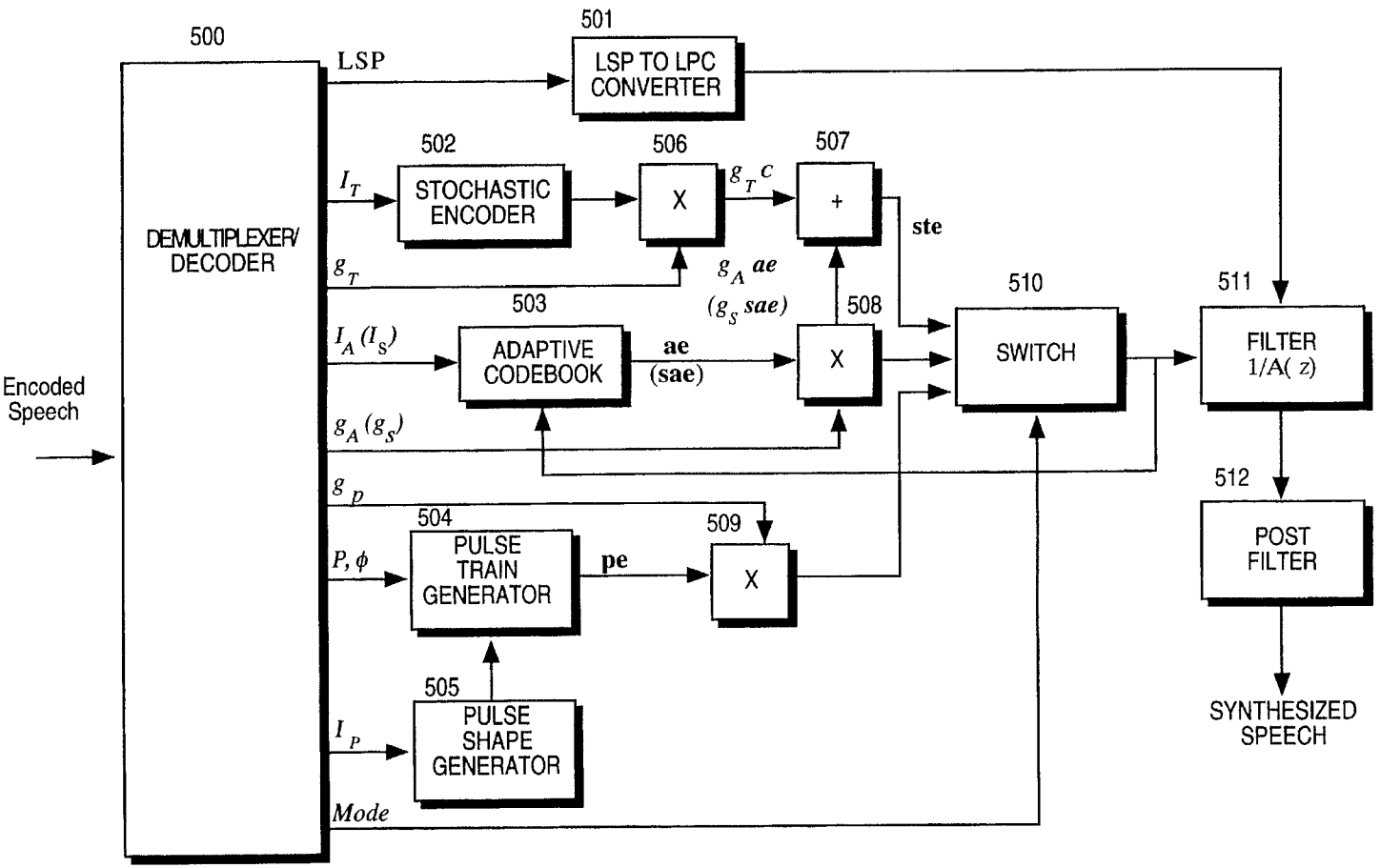
FIG. 5 is a block diagram of a MM-CELP speech synthesizer.

The block diagram in FIG. 5 shows an implementation of a multi-mode trellis encoding and linear prediction (MM-CELP) speech synthesizer. The synthesizer accepts compressed speech data as input and produces a synthesized speech signal. The structure of the synthesizer corresponds to that of the analyzer of FIG. 2, except that trellis encoding has been used.

Input data is passed through a demultiplexer/decoder 500 to obtain a set of line spectrum pairs for the frame (LSPs). The LSP to LPC converter 501 produces a set of linear prediction coefficients (LPCs) for the synthesis filter 511.

For each subframe in the frame, demultiplexer/decoder 500 extracts a search mode, and a corresponding set of excitation parameters (index, gain, pitch, phase), characterizing this mode.

If the mode for a subframe is Pulse, then the pulse shape generator 505 transfers the impulse, with the shape index $I_p$, to the pulse train generator 504. The pulse train generator 504 uses the pitch P, and phase $\phi$, values to produce the excitation vector pe. The vector pe is multiplied in a multiplier 509 by the pulse excitation gain $g_P$, generating a scaled pulse excitation vector $g_P$pe. This $g_P$pe, through the switch 510, controlled by the mode value, is passed to the input of the filter 511, $g_P$pe is also used for updating the content of the ACB.

If the mode for a subframe is ACB, the adaptive codebook 503, addressed by the ACB index $I_A$, produces the excitation vector ae, which is multiplied in a multiplier 508 by the ACB gain $g_A$ to generate the scaled ACB excitation vector $g_A$ae. This vector, through the switch 510, enters filter 511 and is written to the ACB for its innovation.

If the mode for a subframe is SACBS, the adaptive codebook 503, addressed by the shortened ACB index $I_S$, produces the excitation vector sae, that is multiplied, in a multiplier 508, by the shortened ACB gain $g_S$, to generate the scaled shortened ACB excitation vector $g_S$sea.

The stochastic encoder 502 transforms the index $I_T$, into a code word c. A multiplier 506 multiplies c by the gain $g_T$. The adder 507 sums the scaled code vector $g_T$c, with the scaled shortened ACB excitation vector, to produce the excitation vector ste=$g_T$c+$g_S$sae for the processed subframe. The mode signal then causes switch 510 to pass ste through to filter 511. The excitation vector ste is transformed into the synthesized speech by the synthesis filter 511, ste is also used to update the ACB content.

Note that, the output of switch 510 is the excitation corresponding to the selected mode for the subframe. This is used to update the adaptive codebook 503. Also, the output is passed through 1/A(z) filter 511. The output of filter 511 may then be passed through a post-filter 512. If the pre-filter 200 is used in the speech analyzer then the post-filtering of the synthesized speech vector by the post-filter 512 is performed. The output of post-filter 512 is the synthesized speech.

Table 4 gives examples of bit allocation for MM-CELP encoder with the following choice of the parameters: frame length M=240, subframe length L=80, filter order m=10, pulse codebook size=1, ACB size=256, SACB size=16, and SCB size=2048.

An average bit rate of 2270 bps is achieved by using the above-mentioned set of parameters. An additional average bit rate decrease may be attained by pause detecting. In one embodiment, energy test is used for pause detection and only LSP data bits are transmitted during silent subframes, as disclosed in "A multi-mode variable rate CELP coder based on frame classification", Lupini P., Cox N. B., Cuperman V., Proceedings of the 1993 IEEE International Conference on Acoustics, Speech and Signal Processing, pp. 406–409, April 1993.

The average bit rate 1859 bps is obtained under the assumption that voice activity intervals occupy 70% of the whole time. From Table 4 a maximal rate of not more than 2.88 kb/s can be achieved. This fixed bit rate is achieved by introducing two-frames is blocks (a superframe, or superblock), in which not more than three subframes with Pulse or SACBS excitations can exist among a total of six subframes. For each subframe the same bit allocation, as in Table 4, is assumed except for LSP coding. In this case, we use 34-bit independent nonuniform scalar quantization of LSPs, as in the FS-1016 CELP standard.

TABLE 4

| Mode | Pitch and Phase bits | Index (code word number bits | Gain bits 4 | Total bits for mode | Observed search mode selection fre-quency | Number of bits per subframe (average or max.) |
|---|---|---|---|---|---|---|
| Pulse | 11 | 0 | 0 + | 15 | 10% | 1.5 |
| ACB | — | 7 | 4 | 12 | 70% | 8.4 |
| SACBT | — | 4 + 11 | | 19 | 20% | 3.8 |
| Average number of bits for excitation coding | | | | | | 13.7 |
| Maximal number of bits for excitation coding (3*19 + 3*13)/6 | | | | | | 15.5 |
| Average number of bits for LSP coding 21/3 | | | | | | 7.0 |
| Maximal number of bits for LSP coding 34/3 | | | | | | 11.3 |
| Mode number | | | | | | 2.0 |
| Mode number (maximal) | | | | | | 2.0 |

TABLE 4-continued

| Mode | Pitch and Phase bits | Index (code word number bits | Gain bits 4 | Total bits for mode | Observed search mode selection fre-quency | Number of bits per subframe (average or max.) |
|---|---|---|---|---|---|---|
| Total average number of bits per subframe | | | | | | 22.7 |
| Total maximal number of bits per subframe | | | | | | 28.8 |
| Average bit rate without pause detection | | | | | | 2270 bps |
| Maximal bit rate | | | | | | 2880 bps |
| Bit rate on pauses (21/3 + 2)*100 | | | | | | 900 bps |
| Average bit rate with pause detection (30%*900 + 70%*2270) | | | | | | 1859 bps |

Therefore, a more than twice (≦2400 bps) the bit rate decrease is attained by the application of the present invention.

EXAMPLE BIT ALLOCATIONS FOR ENCODED SPEECH

Figure 6:
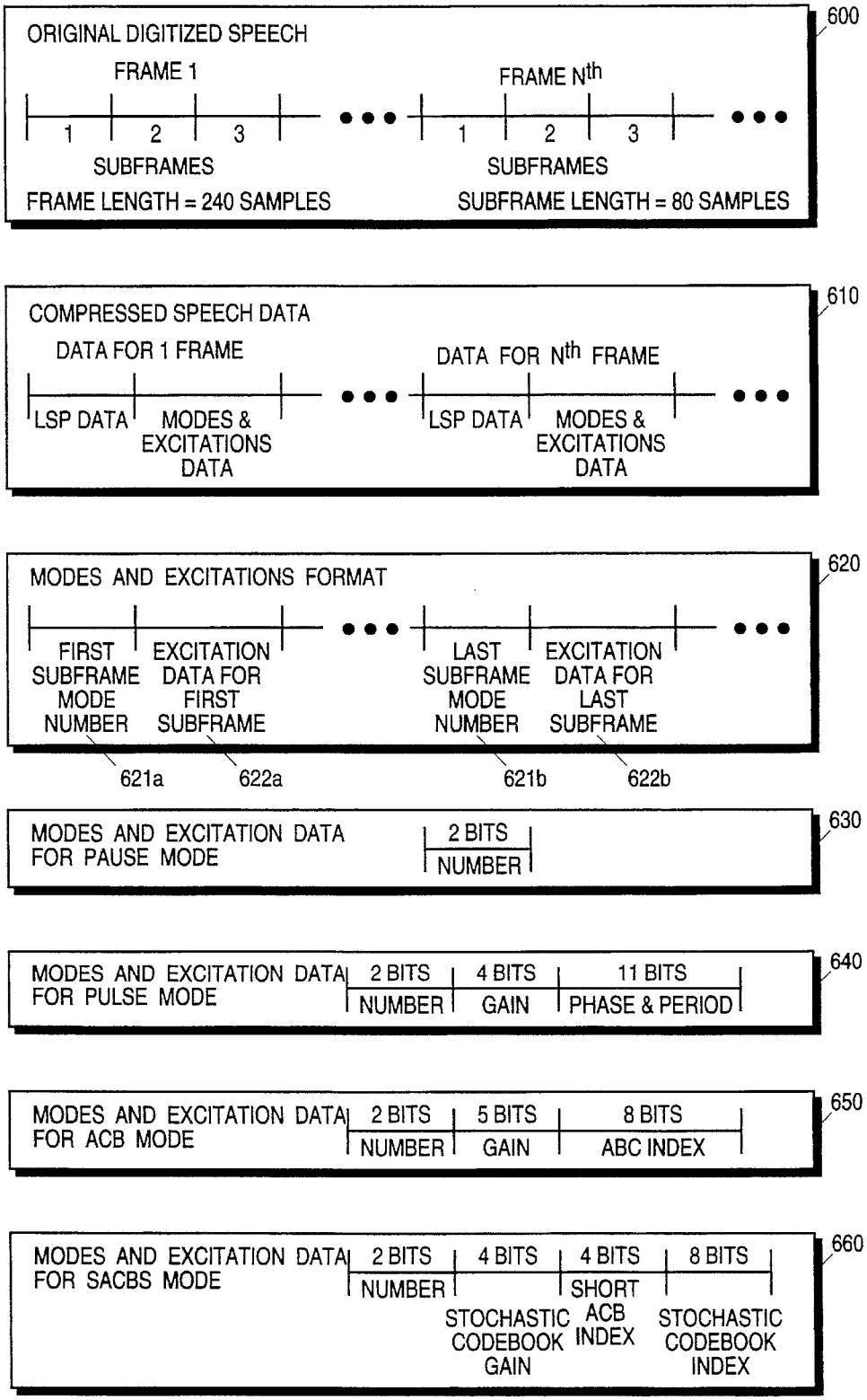
FIG. 6 illustrates example bit stream structures corresponding to encoded speech.

An example of bit allocation and a data bit stream structure corresponding to the above bit allocations are shown in FIG. 6. This figure demonstrates one possible embodiment of the present invention. It is clear to one skilled in this art that using more sophisticated coding means, at the output of the analyzer one can reduce the number of bits in the present bit allocation. This will additionally decrease the bit rate without any loss in the synthesized speech quality.

For the purpose of explaining FIG. 6, consider mode numbers which are transmitted using 2 bits per subframe. Since not all sequences of modes are admissible, and modes are observed with unequal frequencies, the average bit rate for transmitting mode numbers may be reduced by almost half, using variable rate or fixed rate lossless data compression methods.

Bit stream 600 represents the original digitized speech containing many frames. Each frame includes three subframes of 80 samples per subframe.

Compressed speech data 610 includes compressed data for each frame in bit stream 600. For example, frame 1 of 600 has been compressed into LSP data, and modes and excitations data for each subframe in frame 1.

Bit stream 620 represents the general format of the modes and excitations for the subframes of a frame. The first bits represent the first subframe's mode number, 621*a*. Immediately following this is the excitation data for this subframe, 622*a*. The last subframe's mode number 621*b*, and the corresponding excitation data, are at the end of the bit stream representing the frame.

Bit streams 630–660 represent the data for various modes in a subframe. All modes are represented in the first two bits of the stream. Bit stream 630 contains the two bit representation for pause mode for a subframe. Bit stream 640 represents the mode and excitation data for pulse mode. In addition to the mode bits, four bits are used for the gain; and eleven bits are used for the phase and period. Bit stream 650 represents the data for the ACB mode. In addition to the two mode bits, five bits are used for the gain; and eight bits are used for the ACB index. Bit stream 660 represents the data for the SACBS mode. In addition to the first two mode bits, the next four bits represent the stochastic codebook gain. These are followed by the short ACB index of four bits. The next eight bits are the stochastic codebook index.

VARIABLE RATE ENCODING

Encoded excitation data for various modes contains quantized gains and pitches which change slowly from one subframe to another. Any known method for variable rate lossless encoding of these values or their differences may be used for reducing total bit rate for the above-described speech compression system. For example, to achieve greater speech compression (bit rate reducing) pitch and gain differences may be encoded still further by suitable lossless encoding, such as Huffman encoding, use of a Shannon-Fano tree, or by arithmetic (lossless) encoding. As is well known, Huffman codes are minimum redundancy variable length codes, as described by David A. Huffman in an article entitled "Method for Construction of Minimum Redundancy Codes", in Proceedings of the I.R.E., 1952, Volume 40, pages 1098 to 1101. Shannon-Fano encoding makes use of variable length codes, and was described by Gilbert Held in the treatise "Data Compression, Techniques and Applications, Hardware and Software Considerations", 2d Edition, 1987, Wiley & Sons, at pages 107 to 113. See Mark Nelson, "The Data Compression Book", 1992, M&T Publishing, Inc., pages 123–167, for a discussion of lossless encoding.

Moreover some kinds of joint coding for excitation parameters may be used to reduce the number of bits in the bit stream. For example, consider joint phase and period encoding for the pulse excitation mode. Let a frame size be equal to 80. Then we have 80 possible phase values. Since a typical original speech period (pitch) is greater than 20, we have 60 different possible phase values. If we take into account the fact that sum phase+period is less than or equal to 80, then after simple calculations we get only 1910 different possible pairs (phase, period). So 11 bits will be enough for lossless coding of these pairs. Separate pitch and phase coding requires at least 7 bits for phase and 6 bits for pitch, i.e. 13 bits. So, joint phase and pitch coding for pulse sequences saves 2 bits per frame.

An improved method and apparatus for compressing speech has been described.

What is claimed is:

1. An apparatus for processing an input signal, said input signal including a frame, said apparatus comprising:

a first circuit coupled to receive a first signal, said first signal corresponding to said input signal, said first circuit for generating a first set of parameters corresponding to said frame;

a second circuit coupled to receive said first signal and said first set of parameters, said second circuit for generating a second signal;

a pulse train analyzer, coupled to said second circuit, said pulse train analyzer for generating a first match value, a second set of parameters, and a first excitation value;

a fourth circuit, coupled to said second circuit, said fourth circuit for generating a second match value, a third set of parameters, and a second excitation value, said fourth circuit including an adaptive codebook and an adaptive codebook analyzer, said adaptive codebook being coupled to said adaptive codebook analyzer;

a fifth circuit, coupled to said pulse train analyzer and said fourth circuit, for determining a set of admissible excitation search modes based upon a prior excitation search mode, and said fifth circuit further for selecting an excitation search mode from said set of admissible excitation search modes;

a sixth circuit, coupled to said fifth circuit, for selecting a selected set of parameters and a selected excitation corresponding to said excitation search mode, and a seventh circuit, coupled to said first circuit and said sixth circuit, for generating an encoded signal responsive to said selected set of parameters and said excitation search mode.

2. The apparatus of claim 1 further comprising:

an eighth circuit, coupled to said second circuit, said eighth circuit for generating a third match value, a fourth set of parameters, and a third excitation value, and wherein, said fifth circuit is coupled to said eighth circuit.

3. The apparatus of claim 2 wherein said eighth circuit further includes a stochastic codebook analyzer for generating said fourth set of parameters.

4. The apparatus of claim 2 wherein said eighth circuit includes a trellis codebook analyzer for generating said fourth set of parameters.

5. The apparatus of claim 2 wherein said first set of parameters includes linear prediction coefficients (LPCs) corresponding to said frame, and wherein said second circuit is coupled to receive said LPCs and is for performing ringing removal and perceptual weighting of said first signal to generate said second signal.

6. The apparatus of claim 3 wherein each of said second, third, and fourth set of parameters includes an index parameter and a gain parameter.

7. The apparatus of claim 4 wherein said frame includes a subframe, and wherein said second set of parameters corresponds to said subframe.

8. The apparatus of claim 7 wherein said second set of parameters include a pitch parameter, an index parameter, and a phase parameter, and wherein the index parameter includes an index to a shape pulse.

9. The apparatus of claim 7 wherein an index parameter of said third set of parameters includes an index to said adaptive codebook.

10. The apparatus of claim 7 wherein said eighth circuit includes a short adaptive codebook.

11. The apparatus of claim 7 wherein said fifth circuit is for weighting said first, second and third match values prior to selecting said excitation search mode.

12. The apparatus of claim 11 wherein said first match value is weighted by an amount between 0.7–0.9, wherein said second match value is weighted by an amount between 1.1–1.3, and wherein said third match value is weighted by an amount between 0.8–1.0.

13. The apparatus of claim 7 wherein said input signal includes a previous subframe, said previous subframe having said previous excitation search mode, and said fifth circuit is for selecting said excitation search mode responsive to said previous subframe.

14. The apparatus of claim 7 wherein said input signal includes digitized speech.

15. The apparatus of claim 7 further comprising a filter circuit coupled to receive said input signal and for generating said first signal.

16. The apparatus of claim 7 further comprising a line spectrum pair circuit, being coupled to said first circuit and said seventh circuit, for generating line spectrum pair parameters from said first set of parameters, wherein said seventh circuit includes a multiplexing circuit, and wherein said seventh circuit is for multiplexing said line spectrum pair parameters with said selected set of parameters and said selected excitation.

17. The apparatus of claim 2 wherein said fifth circuit is further configured to select said excitation search mode corresponding to one of said set of admissible excitation search modes requiring the least number of bits and complying with a predetermined error threshold.

18. A multi-mode linear predictive coder for processing digital speech signals, said digital speech signals being partitioned into frames of a first predetermined length, where each frame is partitioned into subframes of a second predetermined length, said coder comprising:

a short-term prediction analyzer responsive to said digital speech signals, said short-term prediction analyzer for generating linear prediction parameters and line spectrum parameters;

a variable rate encoder, coupled to said short-term prediction analyzer, for coding differences of said line spectrum parameters by a predetermined variable rate code;

a ringing removal and perceptual weighting circuit for ringing removal and perceptual weighting said digital speech signals to produce predistorted speech vectors for successive subframes;

a multi-mode excitation analyzer, coupled to said ringing removal and perceptual weighting circuit, for generating a set of excitations, a set of match values, and a set of parameters, each excitation in said set of excitations corresponding to a maximal value of a match function in said set of match values;

a pause analyzer, responsive to said digital speech signals, for pause detecting and producing a pause mode signal;

a comparator and controller, coupled to said multi-mode excitation analyzer and said pause analyzer, for weighting and comparing said match function values for each of a plurality of excitation search modes, and for generating a current excitation search mode corresponding to one of said plurality of excitation search modes with a maximal weighted match function value;

a selector of parameters, coupled to said multi-mode excitation analyzer, for generating selected parameters from said set of parameters corresponding to said current excitation search mode; and a selector of excitations, coupled to said multi-mode excitation analyzer, for selecting a current excitation from said set of excitations corresponding to said current excitation search mode.

19. The multi-mode linear predictive coder as recited in claim 18, wherein said multi-mode excitation analyzer further comprises:

an adaptive codebook (ACB) analyzer, coupled to said ringing removal and perceptual weighting circuit, for generating an ACB excitation, an ACB match function and ACB parameters for each subframe in said frame;

a pulse train analyzer, coupled to said tinging removal and perceptual weighting circuit, for generating a pulse excitation, a pulse match function and pulse parameters;

a shortened adaptive codebook (SACB) analyzer, coupled to said ringing removal and perceptual weighting circuit, for generating a SACB codebook excitation and SACB parameters; and a stochastic analyzer, coupled to said ringing removal and perceptual weighting circuit, said stochastic analyzer for generating a stochastic gain, a stochastic codeword index, a stochastic excitation, and a stochastic match function, said stochastic excitation corresponding to said SACB excitation.

20. The multi-mode linear predictive coder of claim 19 wherein said stochastic analyzer is a trellis analyzer, and wherein said stochastic gain is a trellis gain, said stochastic codeword index is a trellis codeword index, said stochastic excitation is a trellis excitation, and said stochastic match function is a trellis match function.

21. A method of selecting encoding parameters, said method for use in a speech synthesizer to improve the subjective speech quality, said method comprising the steps of:

constructing a pulse based upon the time inversion of a pulse response of a response filter;

generating an excitation vector in the form of multiple pitch spaced pulses using a set of pitch values, a set of phase values, and said pulse, said set of pitch values and said set of phase values derived from a perceptually weighted speech signal;

computing energy values and correlation values, said energy values determined using a filtered vector, said correlation values representing the correlation between said filtered vector and said perceptually weighted speech signal, said filtered vector corresponding to said excitation vector; and selecting the pulse excitation from said excitation vector corresponding to correlation values and energy values that maximize a pulse mode match function.

22. The method of claim 21 wherein said method further comprises the step of receiving a set of linear prediction coefficients (LPCs), said LPCs defining a linear prediction (LP) analysis filter of order m, and said step of constructing a pulse uses the following equations:

$$A(z)=1-a_1z^{-1}-a_2z^{-2}-\ldots-a_mz^{-m};$$

$$U(z)=(1-\delta z^{-1})/A(\alpha z);$$

$$V_{0,n-1}(z)=z^{n-1}U_{0,n-1}(z^{-1});$$

$$W(z)=(V_{n-m,n-1}(z)+z^{-n}U_{0,d}(z))A(\beta z);\text{ and}$$

$V_{n,m-1}(Z)=W_{n,M-1}(Z)$; where $X_{i,j}(z)$ represents the polynomial $X_{i,j}(z)=X_iz^{-i}+x_{i+1}z^{-(i+1)}+\ldots+x_jz^{-j}$, $j>i$, where $A(z)$ denotes the Z-transform for the LP analysis filter, where $a_i$ represents one linear prediction coefficient of said set of LPCs, where samples of said pulse are represented by $V_i(z)$, where $n<M$, where $\alpha$ and $\delta$ are empirically chosen constants, $0\leqq\alpha,\delta\leqq1$, where $\beta$ is an empirically chosen constant, $0\leqq\beta\leqq1$, and where d, $d\geqq0$, is a fixed constant.

23. The method of claim 22 wherein $\alpha$ is in the range 0.9 to 0.98, $\delta$ is in the range 0.55 to 0.75, and $\beta$ is in the range 0.6 to 0.8.

24. A pulse train analyzer for use in a speech synthesizer comprising:

a pulse generator coupled to receive a set of pitch values, a set of phase values, and a set of linear prediction coefficients (LPCs), said set of pitch values and said set of phase values derived from a perceptually weighted speech signal, said set of LPCs derived from an input speech signal, said pulse generator producing an excitation vector based upon said set of pitch values, said set of phase values, and said set of LPCs;

a correlation circuit coupled to said pulse generator and further coupled to receive said perceptually weighted speech signal, said correlation circuit using a pulse mode match function to determine a set of match values, said set of match values based upon said excitation vector and said perceptually weighted speech signal; and a pulse train selector coupled to receive said set of match values, said pulse train selector selecting the excitation from said excitation vector that corresponds to the maximal value in said set of match values as a selected pulse excitation.

25. The pulse train analyzer of claim 24 said correlation circuit further comprising:

a response filter coupled to said pulse generator producing a pulse response corresponding to said excitation vector;

a correlator coupled to receive said perceptually weighted speech signal and coupled to said response filter, said correlator computing correlation values between said pulse response and said perceptually weighted speech signal;

an energy calculator coupled to said response filter computing energy values using said pulse response; and a match function calculator coupled to said correlator and said energy calculator to produce said set of match values using said pulse mode match function, said set of match values based upon applying said pulse mode match function to said correlation values and said energy values.

26. The pulse train analyzer of claim 25 said pulse generator further comprising:

a pulse train generator coupled to receive said set of pitch values and said set of phase values, said set of pitch values and said set of phase values derived from said perceptually weighted speech signal, said pulse train generator producing said excitation vector in the form of multiple pitch spaced pulses based upon said set of pitch values, said set of phase values, and a pulse; and a pulse shape generator coupled to said pulse train generator, said pulse shape generator producing a pulse using a formula corresponding to the time inversion of the pulse response.

* * * * *